US011840778B2

(12) United States Patent
Barea

(10) Patent No.: US 11,840,778 B2
(45) Date of Patent: Dec. 12, 2023

(54) METHOD AND SYSTEM TO DETECT THE PRESENCE OF A BROKEN NEEDLE IN A NEEDLE TEXTILE MACHINE

(71) Applicant: BTSR INTERNATIONAL S.P.A., Olgiate Olona (IT)

(72) Inventor: Tiziano Barea, Busto Arsizio (IT)

(73) Assignee: BTSR INTERNATIONAL S.P.A., Olgiate Olona (IT)

( * ) Notice: Subject to any disclaimer, the term of this patent is extended or adjusted under 35 U.S.C. 154(b) by 275 days.

(21) Appl. No.: 17/604,786

(22) PCT Filed: Apr. 29, 2020

(86) PCT No.: PCT/IB2020/054023
§ 371 (c)(1),
(2) Date: Oct. 19, 2021

(87) PCT Pub. No.: WO2020/225655
PCT Pub. Date: Nov. 12, 2020

(65) Prior Publication Data

US 2022/0178056 A1 Jun. 9, 2022

(30) Foreign Application Priority Data

May 9, 2019 (IT) ..... 102019000006681

(51) Int. Cl.
*D04B 35/18* (2006.01)
*D04B 35/12* (2006.01)

(52) U.S. Cl.
CPC ..... *D04B 35/18* (2013.01); *D04B 35/12* (2013.01)

(58) Field of Classification Search
CPC ..... D04B 15/482; D04B 35/18; D04B 35/12; D04B 35/20; B65H 63/04; B65H 63/06; G05B 2219/45194
See application file for complete search history.

(56) References Cited

U.S. PATENT DOCUMENTS 6,219,136 B1 * 4/2001 Kuo ..... G01N 21/8983 66/157
6,318,132 B1 * 11/2001 Gutschmit ..... D04B 35/18 66/157

(Continued)

FOREIGN PATENT DOCUMENTS

DE 4213842 A1 11/1993
EP 279445 A2 8/1988

(Continued)

OTHER PUBLICATIONS

International Search Report and Written Opinion dated Nov. 30, 2020 for PCT/IB2020/054023 to Zwilling BTSR International S.P.A. filed Apr. 29, 2020.

*Primary Examiner* — Danny Worrell
(74) *Attorney, Agent, or Firm* — Vorys, Sater, Seymour and Pease LLP

(57) ABSTRACT

A method for detecting the presence of one or more faulty and/or broken needles in a circular or rectilinear textile machine including a plurality of needles to which yarns are fed from yarn feed devices associated with that machine, each yarn being fed to the textile machine with at least one of its tension, feed speed and quantity fed characteristics being kept monitored and equal to a constant value during the production of an article or part thereof, with the provision of monitoring apparatus for monitoring the at least one characteristic capable of monitoring its value throughout the stage of feeding to the textile machine; provision is made for monitoring the tension and the feed speed of the yarn to identify a periodic variation in the same indicating the existence of at least one broken or faulty needle in the textile machine. A system for implementing this method.

18 Claims, 3 Drawing Sheets

(56) References Cited

U.S. PATENT DOCUMENTS

| | | | | |
|---|---|---|---|---|
| 6,691,534 | B1 * | 2/2004 | Schonauer | D04B 35/18 66/157 |
| 11,739,450 | B2 * | 8/2023 | Lin | D04B 9/06 66/232 |
| 2018/0282915 | A1 * | 10/2018 | Dealey | D04B 15/70 |
| 2019/0106818 | A1 * | 4/2019 | Zenoni | D03D 51/44 |
| 2019/0135574 | A1 * | 5/2019 | Barea | B65H 63/06 |
| 2022/0005182 | A1 * | 1/2022 | Martins Loureiro | D04B 15/00 |

FOREIGN PATENT DOCUMENTS

| | | | |
|---|---|---|---|
| EP | 2780271 | A1 | 9/2014 |
| EP | 2791408 | A1 | 10/2014 |
| EP | 3470564 | A1 | 4/2019 |
| WO | 2013072736 | A1 | 5/2013 |
| WO | 2016091286 | A1 | 6/2016 |
| WO | 2016142901 | A1 | 9/2016 |

* cited by examiner

METHOD AND SYSTEM TO DETECT THE PRESENCE OF A BROKEN NEEDLE IN A NEEDLE TEXTILE MACHINE

CROSS-REFERENCE TO RELATED APPLICATIONS

This is a § 371 National Stage Application of International Application No. PCT/IB2020/054023 filed on Apr. 29, 2020, claiming the priority of Italian Patent Application No. 102019000006681 filed on May 9, 2019.

FIELD OF THE INVENTION

The object of the present invention is a method and system for identifying the presence of a broken needle in a needle textile machine such as a circular machine of small, medium or large diameter or a rectilinear machine according to the preamble of the respective independent claims.

BACKGROUND OF THE INVENTION

In particular, but without limiting reference to circular textile machines, it is known that these machines are used to produce various clothing products, such as knitwear, underwear or socks, as well as various products, including furnishings, for the automotive or other fields (through the use of needles as the knitting components). These machines can have a variety of diameters (defining the families of small, medium and large diameter machines) and comprise a first cylindrical portion presenting a plurality of needles arranged on at least one circumference and moved by their own actuators and a second portion, superimposed upon the first, from which the yarns are directed towards said needles in a known way. Depending on the type of product which has to be made and any images or text upon it, the needle actuators will move said needles text in such a way that they act together with the yarns and cause them to form the fabric of the finished product. Each needle has a movable latch at one end which enables the stitch and therefore the fabric to form.

One of the problems that can occur in circular textile machines is the breakage of a needle (or worse, several needles), partial damage or deformation or jamming of the needle, or a broken latch. For simplicity, all these possibilities will be referred to as "breakage of a needle" or "broken needle" or "faulty needle" in this text.

As a result of this needle breakage the machine produces a faulty article and if such breakage is not identified quickly many faulty articles can be produced, with consequent obvious problems, including on an economic level.

The same reasoning obviously applies to rectilinear machines where a carriage on which the yarn guides are fixed runs over one or more beds of needles able to form the knitted fabric.

Various systems or devices to detect needle breakage in a circular machine during the production process are known. The systems currently and mostly present on the market are generally of the optical type (cameras, optical fibres, etc.) and are fitted to the machine near the needles to detect breakage or deformation of the needle head.

Other devices to intercept or detect needle breakage (or simply "detection devices") comprise a photocell which instead makes it possible to inspect the fabric produced downstream of the needles to detect any vertical runs in it: obviously this type of inspection can only be carried out on machines with non-jacquard processing where the appearance of the garment lends itself to this type of check.

Such known detection systems and devices, although operating satisfactorily, have several limitations.

For example, on some types of machines the system for intercepting or detecting needle breakage (detection systems) is of such a size that it is difficult to apply; this is particularly true for small and medium diameter machines where there is very little space near the needles because of the proximity of the mechanical parts responsible for forming the fabric.

In the case of optical detection devices, these are particularly difficult from the construction point of view and their positioning is therefore also critical. It is in fact necessary to find a position for such a device that does not interfere with the normal operations that operators must perform near the needles, in particular when threading and maintaining the textile machine.

In addition there is generally dirt (paraffin, dust, or other dirt) released near the needles by the yarn itself during processing and this obviously renders meticulous calibration of the system or detection device essential, a calibration that is often not immune to errors. An incorrectly calibrated system may create false alarms and unnecessary machine stops, or may fail to detect faults in the product obtained.

Furthermore, an optical detection system can detect a broken needle, but has difficulty in detecting a bent needle or one with an incorrectly operating latch, and this can always give rise to a fault in the producing head (which is insufficiently obvious to be detected by the optical device), or which can lead to needle breakage in the vicinity of the bent needle.

WO2016/091286 describes a method for monitoring a knitting machine that includes delivering yarn to the knitting machine via a feeder device, measuring the tension of the fed yarn using a tension sensor, or monitoring a yarn parameter using monitoring measuring equipment, where the monitored parameter is the measured yarn tension or a parameter otherwise related to the measured yarn tension. A signal to stop the machine is produced by the monitoring means when a stop condition is notified, said stop condition being defined by the breakage of a needle in such a machine. Needle breakage is identified by the monitoring means monitoring the yarn feed tension when this tension exceeds at least one threshold parameter. This occurrence identifies a needle breakage.

This prior art does not describe use of the yarn feed speed signal to identify needle breakage in the aforesaid machine.

DE4213842 describes an invention similar to that of the prior art summarised above, but in which the monitored parameter also includes the yarn feed speed or a related parameter as an alternative to the yarn tension. In fact, this prior art describes a method for monitoring the function of the needles in a textile machine by measuring the conditions present in at least one yarn (i.e. a parameter of this yarn as it is being fed) that can act together with these needles, such as forces, movements or their derivatives over time, and evaluating the measurement to determine which needles are not operating correctly. In each case only the use of either one of the two above-mentioned parameters (tension and speed) is described for monitoring the correct status and/or correct operation of the machine needles.

EP3470564 describes a method for monitoring yarn take-up in a weaving process, as in a knitting machine, which enables faults to be detected during the weaving process, such as the breakage of needles in the textile machine, in a precise way without being affected by yarn take-up measurement errors (drift), in order to avoid false alarms that could lead to false stoppages. The machine receives yarns from a plurality of feeders, each equipped with its own monitoring unit that calculates the present value of the quantity of yarn taken up and compares it with a reference value, said unit generating an alarm if there is a difference between said values. The monitoring unit periodically calculates an average yarn take-up on the basis of a predetermined number of products already manufactured, compares this average take-up with the reference value and, if the difference between the two values is higher than a predetermined maximum percentage threshold value, sets the average take-up value as a reference value.

SUMMARY OF THE INVENTION

Thus the object of this invention is to provide a method and system for detecting a broken or bent needle or its broken latch (which may be missing or jammed or not working properly) in a circular textile machine with absolute certainty.

Another object of the invention is to provide a method of the above-mentioned type that can be implemented without adding mechanical components to the machine, but operating on its components, in particular on constant tension/speed yarn feeders already present on the textile machine.

A further object of the invention is to provide detection system of the type mentioned above that can be easily applied to all textile machines on the market and new generation machines.

Another object of the invention is to provide a system of the kind mentioned above which is economical and which also makes it possible to monitor the quality of production with absolute certainty.

A further object of the invention is to provide a method and system of the type mentioned above that is able to stop the textile machine if a fault is detected in a needle in order to avoid the production of faulty products.

These and other objects which will be apparent to those skilled in the art are accomplished through a method and system for detecting needle breakage in a circular textile machine according to the corresponding independent claims.

BRIEF DESCRIPTION OF THE DRAWINGS

For a better understanding of the present invention there are attached by way of example, but without being limited thereto, drawings in which.

DETAILED DESCRIPTION OF THE PREFERRED EMBODIMENTS

Figure 5:
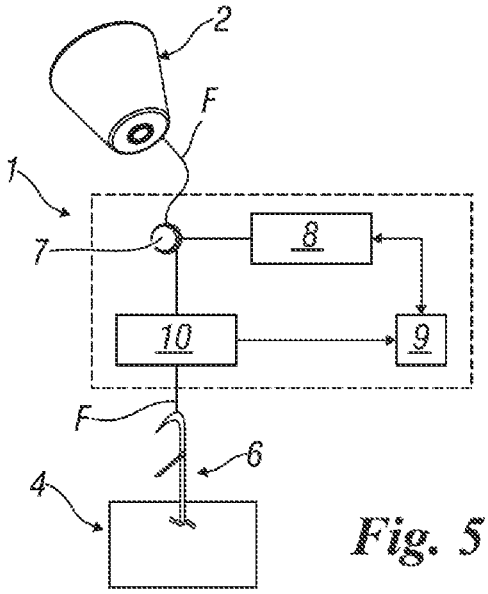
FIG. 5 schematically shows a system for implementing the method according to the invention.

With reference to the above figures, a system according to the invention includes a feeder device 1 for yarn F that receives this yarn from a bobbin 2. The feeder device 1 is of a known type and from it said yarn is fed to a circular textile machine 4 equipped with a plurality of moving needles, each capable of acting together with a corresponding yarn to create a knitted fabric (such as a stocking or a sweater). In FIG. 5 this device 1 and machine 4 are shown in a generic way, just as a needle 6 of this textile machine 4 acting together with yarn F is shown in a generic way.

Needle 6 is moved by actuators which are in themselves known and not illustrated.

The feeder device 1 is of the type able to feed the yarn F at a constant tension and/or speed ("tension/speed"), and various types of constant tension/speed yarn feeders are known in the state of the art.

For simplicity and by way of example, but not limited thereto, in the rest of the description reference will be made to a constant tension feed device 1 of the positive type, in which there is a pulley 7 on which the yarn F is wound without slip, monitored by a motor 8 whose torque/speed is monitored by a monitoring unit or electronic card 9 according to the value of the tension in the yarn through a tension sensing device such as a load cell 10; this is in order to keep the tension of the yarn F within preset limits during the whole working process.

During processing at constant speed (no selection, that is when processing without any changes in take-up by the textile machine) feeders of this type are able to keep the tension of the yarn F exactly the same as with the set tension. In fact, when examined using known external instrumentation (e.g. an oscilloscope or software debugging tool able to graph changes in the monitored tension, and the motor speed and torque) the traces for the two variables (feed tension and speed) show two substantially flat traces A and B (see FIG. 2), the first relating to the tension and the second to the pulley rotation speed. In a known way the first variable is detected through the electrical signals generated by the load cell 10 and the second variable is detected by a sensor, which is in itself known, able to detect the rotation speed of the pulley 7. This value therefore corresponds to the yarn feed speed.

Figure 2:
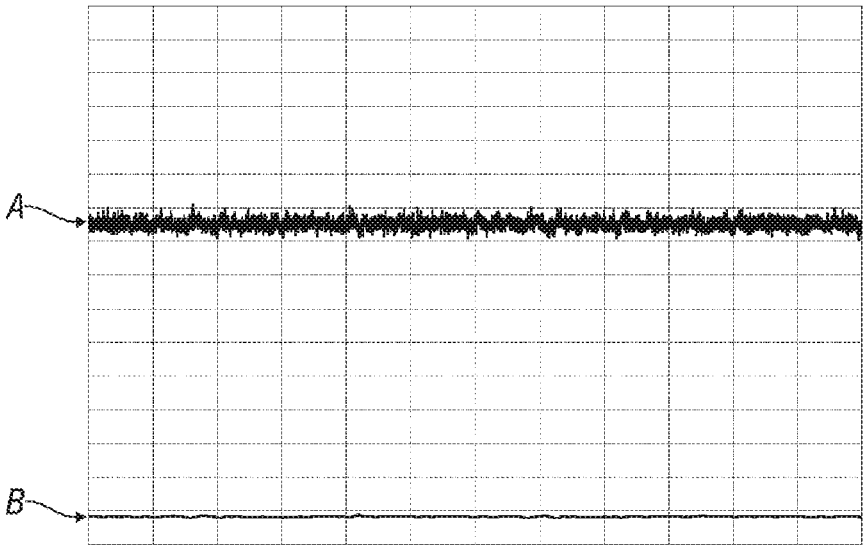
FIG. 2 shows a graph of the tension and speed signals for a yarn fed to a yarn feeder device used to feed this yarn to a needle of a circular textile machine in the case of a needle in perfect working order.

It will be seen from FIG. 2 that the tension (trace A) is regular and does not show any positive or negative peaks. At the same time the speed (track B) is also regular and there are some slight oscillations due to the need to compensate for the tension of the yarn entering the feeder device 1.

In the case described above, where the detected signals corresponding to tension and speed are substantially constant, the system according to the invention (operating through the monitoring unit 9 of the feeder unit 1) does not detect any structural problem in needle 6 (breakage or bending, for example).

Figure 1:
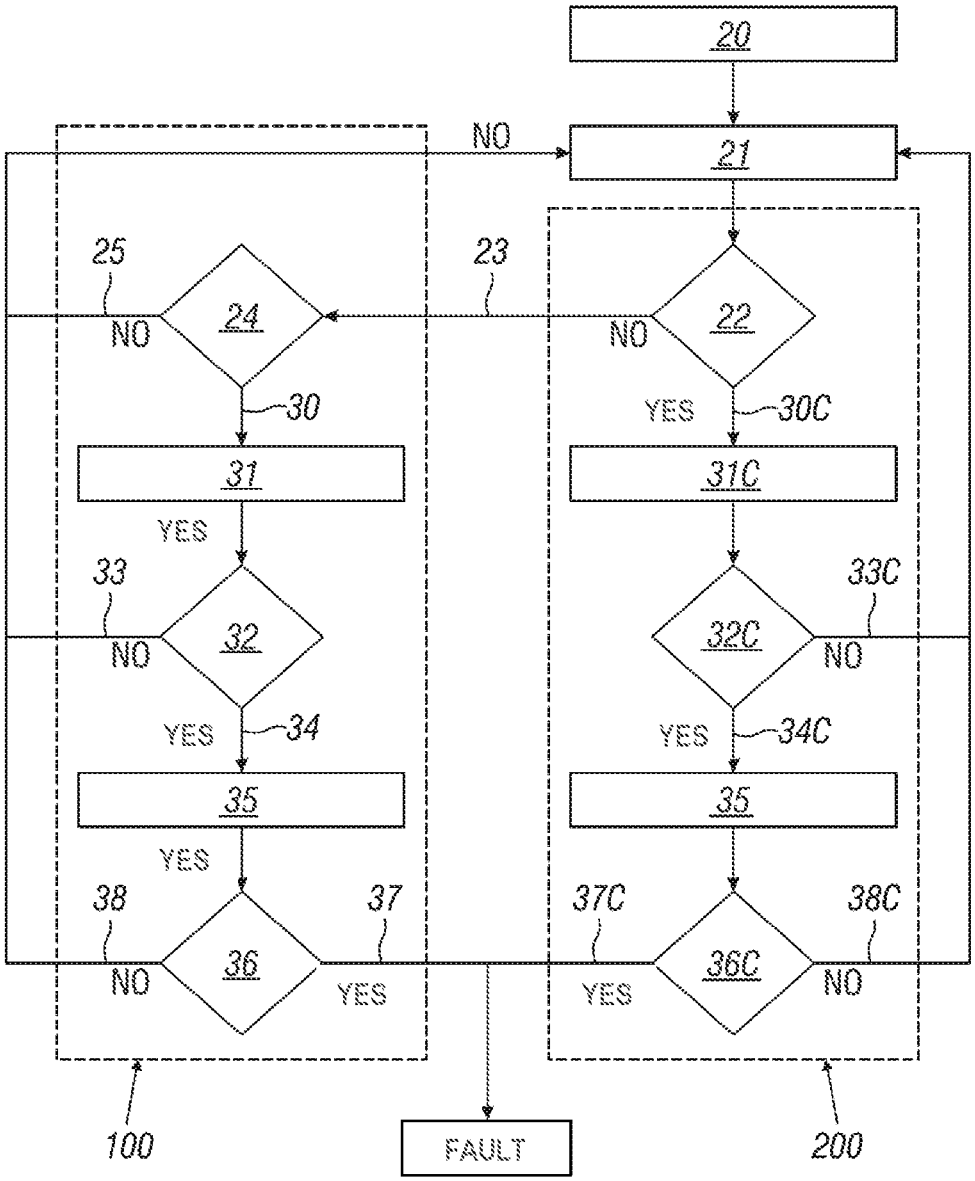
FIG. 1 shows a flow chart illustrating one embodiment of a method according to the invention.

Thus, with reference to FIG. 1, after being activated (block 20 of FIG. 1) and measuring the tension and speed of the yarn F (block 21), the method according to the invention checks if there is a change or a peak in the yarn tension (decision block 22), and if not (branch 23), whether there is a change or peak in the speed (decision block 24).

If none (branch 25), as is the case in FIG. 2, it returns to block 21.

Figure 3:
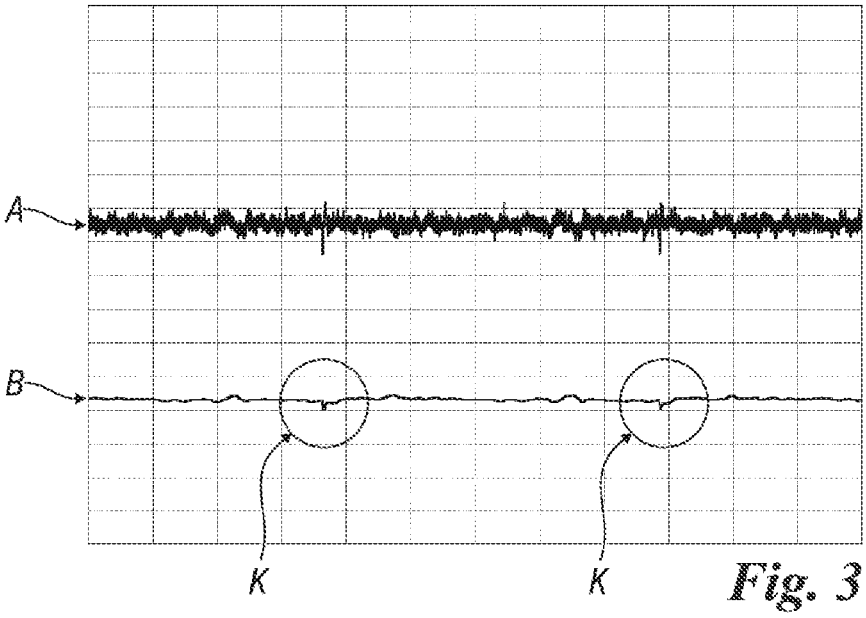
FIG. 3 shows a graph similar to that in FIG. 2, but in a situation where there is a broken needle and the feeder device is acting to compensate for the consequent disturbance in the take-up of yarn by the textile machine.

Conversely, if there is a broken or bent needle, take-up of the yarn F by the textile machine 4 is no longer perfectly linear due to the disturbance introduced by the mechanical fault. In this case either of the consequences indicated below may occur:

a) the disturbance introduced by needle 6 (sudden or anomalous change in yarn take-up) is perfectly compensated for by the monitoring algorithm of the unit 9 of the device 1 which, acting on the motor 8, is able to keep the tension the same as the set tension in any circumstance; this, however, is achieved by abruptly varying the rotation speed of the pulley 7. With reference to FIG. 3, the track A relating to the tension will still be flat, but the track B will have a periodic disturbance K indicating a strong deceleration followed by a repeated acceleration.

Figure 4:
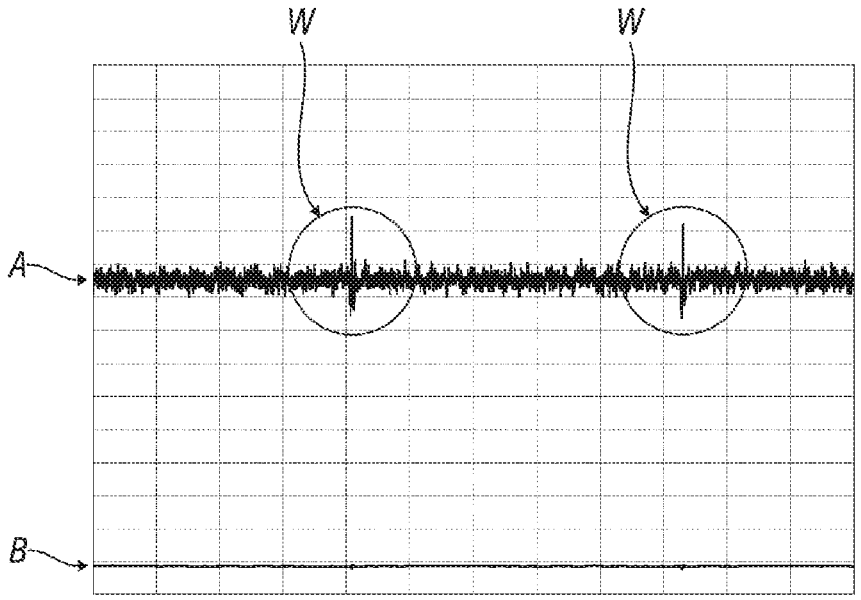
FIG. 4 shows a graph similar to that in FIG. 3, but in a situation where the feeder device fails to compensate for the resulting disturbance in take-up.

This enables the monitoring unit 9 to detect the mechanical fault in the needle 6. Once the periodicity of the fault has been identified, the monitoring unit 9 can then decide to signal the fault via its own display ("warning"), or via a machine display if the system is incorporated, or can stop the machine ("stop") through a digital output. This signal ("warning" or "stop") may be immediate (at the first fault) or delayed for greater safety, for example it might be generated when it is realised that the fault has repeated itself identically a certain number of times, which might be programmable. Obviously in the case of an accumulation feeder device (such as the one described in EP2791408 or EP2780271 or 279445 in the name of the same Applicant) it is not the motor speed that is monitored but the current used to power an electromagnet that slows down the yarn fed to the textile machine; thus the monitoring unit 9 of such feeder device will record a current pulse that is generated to compensate for the change in take-up by the textile machine. (b) the disturbance introduced by the needle (sudden or abnormal change in the take-up of the yarn F by the machine 4) is not perfectly compensated for by the monitoring algorithm. With reference to FIG. 4, in the situation in question the monitored variables (tension and speed) will generate an average flat trace B for the speed (in the measuring instrument), while the trace A representing the tension shows a periodic disturbance W, indicating a sudden tension drop followed by a tension peak.

This is detected by the monitoring unit 9 as the presence of a mechanical fault in the needle 6, with the consequences mentioned above.

The two situations a) and b) described above are illustrated in FIGS. 3 and 4, in particular through the flow lines 100 and 200 in the diagram shown in that figure, the first flow line 100 relating to the situation of the disturbance resulting in a change in the yarn feed speed and the second flow line 200 relating to the case of the disturbance resulting in a change in the tension of the yarn F.

Considering the flow line 100 (relating to the speed signal), if a peak in the speed is detected (branch 30) when evaluating the block 24, the data for the detected peak and the time at which it is detected (within the yarn feeding period) are stored in a memory buffer (block 31). It will be noted that the speed peak fault can for example be identified by the monitoring unit 9 as a comparison between an instantaneous speed and an average speed; in this case a sudden deceleration in succession to the average speed followed by a sudden acceleration such as would identify this fault will be noted.

The presence of other peaks is evaluated in a subsequent block 32: if no peaks are detected, it returns to the block 21 (branch 33); in the case of a positive response (branch 34), the time period in which it occurs is stored (block 35) and in a subsequent block 36 it checks whether there is a time periodicity in detection of the peaks. If this periodicity is detected (branch 37) the monitoring unit 9 establishes that there is a fault in the needle; if not (branch 38) it returns to the block 21. Following identification of the fault, the monitoring unit 9, having identified a periodicity in the fault, can then decide to signal the fault ("warning") via one of its displays, or via a machine display if the system is incorporated, or can stop the machine ("stop") via a digital output. This signal ("warning" or "stop") can be immediate (on the first fault) or delayed for greater safety, for example it may be generated when it is realised that the fault has repeated identically a certain number of times, which might be programmable.

The flow line 200 operates parallel to the line 100 and in it all the steps 30-38 in the line 100 are indicated using the same numerical references followed by the letter C. These steps 30C-38C correspond to the steps 30-38, but with actions performed in relation to the detected tension in the yarn F.

It is therefore evident how by continuing to monitor changes in the "feed speed" variable and the "yarn tension" variable the detection system as described is able to safely detect a disturbance on the monitored tension or the measured and set speed of pulley 7 (both measured and monitored through the monitoring unit 9 of the feed device), a disturbance that repeats itself with a constant frequency/period, and attribute this disturbance to the existence of a broken needle (or one that does not work correctly) in the textile machine ("faulty needle") (always reliably, precisely because the detection system operates on two yarn feeding parameters for which the data are both checked).

This type of monitoring can also be applied to constant speed feeders, even old generation ones (belt feeders present on many medium and large diameter circular machines), simply by adding a downstream tension sensor and monitoring the changes in yarn tension as previously described.

It is obvious to a person skilled in the art how this type of monitoring can also be applied to accumulation feeders, possibly by adding a tension sensor downstream of the same if not already present as in those of the latest generation.

In the case of an accumulation feeder unit, such as the one covered by the patent mentioned above, the monitoring as described above is performed by monitoring the tension and current used to power the slowing electromagnet (or similar device) to keep the tension of the fed yarn constant.

Therefore, the described system is able to detect a needle fault with absolute certainty in small and medium diameter circular machines where there is always a working or article production area where take-up of the yarn is constant (and therefore occurs with at a constant tension and feed speed).

A stage of processing at constant speed and without selection has been described. However, the invention also applies to the case in which the textile machine makes various selections of yarn during the production stage, i.e. this takes place with the machine operating at a variable speed.

In this case, anomalous tensions and/or speeds are already present during processing due to changes in the take-up of the yarn during normal feeding. Two possible solutions may be used to detect a faulty (broken, bent, etc.) needle.

A first solution relates to the situation in which there is an area without selection within the head. In this case the check described above can only be made at that point. It will then be the machine, suitably interfaced with the feed device (through serial bus or digital inputs/outputs) which activates and deactivates the check. If such interfacing is not possible, it is possible to operate as described in WO2016/142901 in the name of same Applicant and to divide production into its various areas and select a specific operating programme for the unit 9 that will allow monitoring to be activated and deactivated when desired (i.e. in one or more areas without selection).

A second solution relates to the case where there are no areas with constant take-up. In this case the monitoring unit 9 can engage in a learning cycle through which abnormalities (tension/speed) due to machining can be stored. During subsequent monitoring cycles the monitoring algorithm in the unit 9 will check further repetitive anomalies (tension/speed) not present in the learning cycle so as to discriminate when a broken or not perfectly working needle is present.

The procedure described is however able to distinguish between a broken needle in the machine 4 and broken yarn F through monitoring the periodicity of the changes in the monitored variable, a periodical change that is not present in the case of broken yarn.

Synchronization of the monitoring system described above with the textile machine provides other advantages.

Having, for example, a relevant synchronous signal every turn of the machine drum and knowing the number of needles present in it, it is possible to identify the exact position of the broken needle, simplifying the work of the operator in replacing the damaged component. In fact, by obtaining a signal relating to the revolution of the drum from the textile machine (circular machine) or the direction of the carriage (linear machine), the monitoring unit 9 can identify the position of the broken needle knowing the time needed for one revolution of the drum and comparing it with the elapsed time between said signal and the detected fault. For example, imagining that the machine performs one revolution every 500 ms, if the fault occurs 100 ms after the synchronisation signal, and knowing that the machine has 500 needles, the problem can be attributed to needle 100.

Another advantage relating to synchronisation may be the following: by monitoring not only the tension and the yarn feed speed but also the quantity of yarn fed for each whole article produced (small or medium diameter circular machines), to produce a portion of it (medium and large diameter circular machines) or a multiple of portions of manufactured articles or whole manufactured articles, it is possible to detect the breakage of a needle by detecting decreased yarn take-up in one of the feed devices present in the machine. A broken needle can in fact cause a reduction in the length of yarn taken up (LFA="lunghezza di filo assorbita") causing, for example, runs in a sock. On the other hand if the latch of a needle breaks the LFA increases.

If there is a faulty needle (broken, bent, or with a broken latch, etc.), this will always lead to a change in the LFA; when checking portions of manufactured products or whole finished products, by comparing the (actual) measured value of the LFA with a (predetermined or learned) reference value and subsequently determining the standard deviation or a mere change in this comparison value in comparison with the LFA data collected from the production of a multiplicity of manufactured portions or whole or finished products, the actual change in the LFA can be detected, thus identifying the needle fault.

A system as described is therefore always able to detect the breakage of a needle, a bent needle, a broken or a jammed latch with absolute certainty even in case of jacquard type machining, where there is no working area with a constant take-up. In this case, since there is constant change in the speed and monitored tension (sometimes not always perfectly compensated for), the system acts by storing the changes in tension, the motor torque 8 and the yarn feed speed in a sample cycle (self-learning), as described above, and in subsequent cycles detecting any deviations from the learned values of the variables measured.

The present system is therefore also able to detect a faulty (broken, jammed, etc.) needle through monitoring the torque of the motor 8 (which is proportional to the yarn feed speed).

Various embodiments of the invention have been described. Yet others are possible for those skilled in the art in the light of the above description and will thereby fall within the scope of the following claims.

The invention claimed is:

1. A method to detect the presence of at least one faulty and/or broken needle in a circular or rectilinear textile machine comprising a plurality of needles to which yarns from yarn feed devices associated with that machine are fed, feeding each yarn to the textile machine with at least one characteristic thereof, tension, feed speed and quantity fed, being monitored and kept equal to a constant value during the production of a manufactured article or part thereof, with provision of monitoring means monitoring said at least one characteristic that is capable of monitoring the value of the at least one characteristic throughout the feeding of the yarn to the textile machine, intended to detect any disturbance in the value of the characteristic monitored, to identify any periodicity in said disturbance and whether the disturbance repeats periodically, said monitoring means identifying the presence of a faulty and/or broken needle in the textile machine, wherein the tension characteristics of the yarn and feed speed of the yarn are monitored in order to identify a broken and/or faulty needle through the detection of a periodic variation in one of these characteristics of the yarn.

2. The method according to claim 1, wherein said monitoring of the characteristic of the yarn is performed in a stage of processing at constant speed and without selection by the textile machine or in a stage in which the textile machine operates at variable speed when selection is present.

3. The method according to claim 2, implemented in the case of a textile machine operating at a variable speed, wherein provision is made for a first monitoring of the characteristics of the yarn in a production stage of the textile machine in which there is no discontinuity in take-up of the yarn by the textile machine, thus allowing the monitoring means to synchronise its action with the textile machine, said first monitoring being followed by a stage of self-learning of the values of the monitored characteristics during the stage in which the textile machine operates at a variable speed, and by a second monitoring of these characteristics of the yarn performed on the basis of the self-learning values, said second monitoring being performed in each stage in which the textile machine operates at a variable speed in the production process.

4. The method according to claim 1, wherein provision is also made for monitoring the quantity of yarn fed or the length of yarn fed for each manufactured article produced by the textile machine or for each portion of that article or for a plurality of portions of the manufactured article or the finished articles produced.

5. The method according to claim 4, wherein the length or quantity of fed yarn used to produce a plurality of portions of manufactured or finished products is compared with a predetermined or self-learned value and a comparison value is determined, changes in this comparison value with respect to the corresponding data for the length or quantity of yarn fed to produce a multiplicity of portions of manufactured or finished products are determined and the existence or non-existence of a faulty and/or broken needle is determined according to this comparison.

6. The method according to claim 1, wherein the monitoring means are synchronised with the textile machine so as to identify the damaged needle precisely from among the plurality of needles in the textile machine.

7. The method according to claim 1, wherein following the detection of a damaged needle, provision is made either to generate only a fault detection signal on a display of the monitoring means or the textile machine or to stop that textile machine.

8. The method according to claim 1, wherein said feed devices are positive type feeders comprising a rotating member driven by its own electric motor which feeds the yarn to the textile machine, the characteristic of the speed of the yarn being detected through monitoring the rotation of said rotating member and/or the torque generated by the motor.

9. The method according to claim 8, wherein the torque provided by the electric motor as well as the tension and speed characteristics of the yarn during one cycle in the production of a sample article by the textile machine in which self-learning of the values of these characteristics has been performed is stored and these stored values are compared with corresponding actual values measured during the production of at least one article or at least one portion thereof so as to identify the faulty and/or broken needle.

10. The method according to claim 1, wherein said feed devices are either accumulation feeders or constant speed feeders, with provision for detection of the tension in the yarn through the provision of a tension sensing device between said feeders and the textile machine.

11. The method according to claim 1, wherein the monitoring means is a unit monitoring the yarn feeder device.

12. A system for performing the method of claim 1 to detect the presence of a faulty and/or broken needle in a circular or rectilinear textile machine comprising a plurality of needles for being fed yarns are fed from feed devices associated with the textile machine, each yarn being fed to the textile machine with at least one of the yarn's tension, feed speed and/or quantity or length of yarn fed characteristics being monitored and being equal to a constant value during the production of an article or a portion thereof, the system comprising:

monitoring means to monitor said at least one characteristic of the yarn which is adapted and configured for monitoring the value of the at least one characteristic of the yarn during the feeding of the yarn to the textile machine, wherein said monitoring means is adapted and configured for detecting any disturbance in the value of the monitored tension and feed speed characteristics of the yarn to detect a faulty and/or broken needle in the textile machine when said monitoring means detects a periodic repetition of disturbances in said value of one of these characteristics of the yarn.

13. The system according to claim 12, wherein said feed devices are either a positive feeder, an accumulation feeder or a constant speed feeder, the monitoring means being a monitoring unit for said feeders which acts together with a tension sensing member for the yarn placed between the feeders and the textile machine, said tension sensing member being part of the feeders or being independent with respect to the feeders.

14. The system according to claim 12, wherein said monitoring means is also adapted and configured to detect a disturbance in the value of the quantity or length of yarn fed.

15. The system according to claim 14, wherein the feeder device has a rotating member driven by an electric motor, wherein the monitoring means is adapted and configured to monitor the rotation of this member or the torque generated by such electric motor to detect the speed of feeding of the yarn and/or the quantity or length of yarn fed.

16. The system according to claim 13, wherein the monitoring unit is synchronised with the entire operating stage of the textile machine for the production of an article so as to identify any disturbance in the monitored characteristics of the yarn detected in the production of a finished article or a portion thereof or a plurality of finished articles or portions thereof, said synchronisation enabling the monitoring unit to identify the damaged and/or broken needle from the plurality of needles in the textile machine.

17. The system according to claim 12, wherein said feed devices are either a positive feeder, an accumulation feeder or a constant speed feeder.

18. The system according to claim 12, the monitoring means being a monitoring unit for said feed devices which acts together with a tension sensing member for the yarn placed between the feeders and the textile machine, said tension sensing member being part of the feed devices or being independent with respect to the feeders.

* * * * *